US006246424B1

(12) United States Patent
Desie et al.

(10) Patent No.: US 6,246,424 B1
(45) Date of Patent: Jun. 12, 2001

(54) DEVICE FOR LARGE FORMAT PRINTING COMPRISING A SINGLE CENTRAL CONDITIONING UNIT FOR CONTROLLING AND MONITORING THE CONDITION OF THE DEVELOPER

(75) Inventors: Guido Vital Desie, Herent; Hilbrand Leopold Van den Wijngaert, Grobbendonk; Jacques Victor Leonard, Antwerp; Peter Bourbon, Sint-Katelijne-Waver, all of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/420,244

(22) Filed: Oct. 19, 1999

Related U.S. Application Data

(60) Provisional application No. 60/118,819, filed on Feb. 5, 1999.

(30) Foreign Application Priority Data

Nov. 16, 1998 (EP) ..... 98203873

(51) Int. Cl.[7] ..... B41J 2/415

(52) U.S. Cl. ..... 347/124; 347/55

(58) Field of Search ..... 347/151, 123, 347/124, 55; 399/29, 30, 135, 149, 358, 359, 269, 272, 281, 282

(56) References Cited

U.S. PATENT DOCUMENTS

| | | | | |
|---|---|---|---|---|
| 4,464,682 | * | 8/1984 | Lindahl . | |
| 5,397,192 | | 3/1995 | Kormacee . | |
| 5,420,617 | | 5/1995 | Yoshino . | |
| 5,493,382 | * | 2/1996 | Takagaki et al. | 399/359 |
| 5,555,469 | * | 9/1996 | Ishikawa et al. | 399/258 |
| 5,559,579 | | 9/1996 | Gwaltney et al. . | |
| 5,797,074 | | 8/1998 | Kasahara et al. . | |
| 5,900,893 | * | 5/1999 | Joly et al. | 347/55 |
| 6,074,112 | * | 6/2000 | Desie et al. | 347/55 |

FOREIGN PATENT DOCUMENTS

| | | |
|---|---|---|
| 687962 | 6/1995 | (EP) . |
| 785484 | 6/1995 | (EP) . |
| 849645 | 12/1997 | (EP) . |
| 849087 | 6/1998 | (EP) . |
| 2257658 | 4/1992 | (GB) . |

* cited by examiner

*Primary Examiner*—Sandra Brase
(74) *Attorney, Agent, or Firm*—Baker Botts L.L.P.

(57) ABSTRACT

A large format single pass printer, having a printing width (PW) for printing a toner image on a substrate, the substrate having a width (WS) and a length (LS), comprising a printhead structure with an array of printing apertures, with length, $L_A$, and control electrodes associated therewith, a charged toner conveyer, CTC, with a length, $L_{CTC} \geqq L_A$ and a number n, equal to or larger than 2, of toner applicators with width $PWE_i < L_{CTC}$ for applying charged toner particles to said CTC, said number n being chosen such that $$\sum_{i=1}^{i=n} PWE_i \geq L_A, \text{ wherein}$$

wherein i) a single central conditioning unit for controlling and monitoring the condition of the developer is provided, and ii) the central conditioning unit is equipped with means for circulating the developer to all of the toner applicators and back to the central unit.

15 Claims, 6 Drawing Sheets

DEVICE FOR LARGE FORMAT PRINTING COMPRISING A SINGLE CENTRAL CONDITIONING UNIT FOR CONTROLLING AND MONITORING THE CONDITION OF THE DEVELOPER

The application claims the benefit of U.S. Provisional Application No. 60/118,819 filed Feb. 5, 1995.

FIELD OF THE INVENTION

This invention relates to a printing apparatus for large format printing. It relates especially to a large format printer comprising electrostatographic printing devices.

BACKGROUND OF THE INVENTION

In large format printing, e.g. poster printing, billboard printing, sign printing, the weatherability of the print is very important. In that area silk-screen printing is still a dominant printing method. This method has however many drawbacks: first of all it is rather time consuming since for every color a dedicated screen has to be made and printed, the method is basically analogue and not well compatible with digital input files.

More and more images to be printed are available in digital form, so that also in the printing of large formats, digital addressable printing techniques become indispensable.

A well known digital addressable printing technique that is useful for large format printing is ink-jet printing, both with water based inks and with solvent based inks. An example of an ink-jet printer for large format printing can be found in, e.g. U.S. Pat. No. 5,488,397, wherein a printer is disclosed having two or more parallel ink-cartridges shuttling over the width of the substrate to be printed while the substrate moves in a direction basically perpendicular to the direction of movement of the shuttling ink-cartridges.

In WO-A-96/01489 an ink-jet printer for large format printing is disclosed wherein a single ink-cartridge shuttles over the substrate to be printed.

In U.S. Pat. No. 4,864,328 an in-jet printer is disclosed, wherein only one printing engine (ink-jet head) having a multiple array of nozzles is moved as a shuttle over the paper.

In EP-A-526 205 again an ink-jet printer is disclosed, wherein only one printing engine (ink-jet head) having a multiple array of nozzles is moved as a shuttle over the paper.

A commercial ink-jet printer IDANIT 162Ad (trade name) available from Idanit Technologies, Israel, uses multiple ink-jet printheads mounted in a staggered position over the width of the substrate to be printed. In this device the printing substrate has to pass several times under the array of staggered ink-jet printheads while between each pass the printheads are slightly moved with respect to the drum in a direction parallel to the width of the substrate. This multi-pass printing enhances the resolution that can be printed, while in the printhead itself the nozzle can be positioned fairly far apart. The same concept (but with much less printheads) has also be commercially implemented in printers such as the LASERMASTER DESIGNWINDER, IRIS REALIST, STORK TEXTILE PROOFER, POLAROID DRYJET (trade names), . . . and is e.g. further described in WO-A-96/34762.

Although ink-jet printing provides the possibility for printing large formats in short time, the resulting printing quality is not always up to the demands, the stability of the image in, e.g. billboards where the image has to be weatherproof leaves still room for improvement.

In U.S. Pat. No. 5,138,366 a thermal printer using at least two thermal printing heads is described for printing on large substrates. The maximum format for a commercially available large format printer using thermal technology, however, is 36 inch, as provided by the Matan Sprinter, Israel.

In U.S. Pat. No. 5,237,347 an electrophotographic printer is disclosed wherein a single photoconductor is exposed to the light of several exposure units, so a large latent image can be written on the photoconductor and after development be transferred to a final substrate. The printer having the largest printing width for printing full color images based on electrophotographic techniques, is e.g. the Xeikon DCP50, having a printing width of 50 cm. In electrostatic technology full color printing machines having a printing with of 54 inch are available, said devices being fed with liquid electrophotographic developer.

In WO-A-96/18506 a shuttling printer using more than one Direct Electrostatic Printing (DEP) engine is disclosed wherein these engines are placed one after the other for printing multi-color swaths.

In DEP (Direct Electrostatic Printing) toner particles are deposited directly in an image-wise way on a receiving substrate, the latter not bearing any image-wise latent electrostatic image.

This makes the method different from classical electrography, in which a latent electrostatic image on a charge retentive surface is developed by a suitable material to make the latent image visible, or from electrophotography in which an additional step and additional member is introduced to create the latent electrostatic image (photoconductor and charging/exposure cycle).

A DEP device is disclosed in e.g. U.S. Pat. No. 3,689,935. This document discloses an electrostatic line printer having a multi-layered particle modulator or printhead structure comprising:

- a layer of insulating material, called isolation layer;
- a shield electrode consisting of a continuous layer of conductive material on one side of the isolation layer;
- a plurality of control electrodes formed by a segmented layer of conductive material on the other side of the isolation layer; and
- at least one row of apertures.

Each control electrode is formed around one aperture and is isolated from each other control electrode.

Selected electric potentials are applied to each of the control electrodes while a fixed potential is applied to the shield electrode. An overall applied propulsion field between a toner delivery means and a support for a toner receiving substrate projects charged toner particles through a row of apertures of the printhead structure. The intensity of the particle stream is modulated according to the pattern of potentials applied to the control electrodes. The modulated stream of charged particles impinges upon a receiving substrate, interposed in the modulated particle stream. The receiving substrate is transported in a direction perpendicular to the printhead structure, to provide a line-by-line scan printing. The shield electrode may face the toner delivery means and the control electrodes may face the receiving substrate. A DC-field is applied between the printhead structure and a single back electrode on the receiving substrate. This propulsion field is responsible for the attraction of toner to the receiving substrate that is placed between the printhead structure and the back electrode.

In EP-A-849 087 a single pass large format printer is disclosed, having at least two printing engines (DEP engines or electrophotographic engines) which are staggered with respect to the printing direction so that a large format image can be printed which is larger in size than the printing width of one of said printing engines.

In EP-A-849-645 a large format printer is disclosed having a page wide DEP-printhead structure combined with multiple smaller sized toner applicator modules, and in EP-A-849 640 a large format printer is disclosed having a page wide photoconductor combined with multiple smaller sized toner delivery means.

In the art of printing large formats, however, slight density fluctuations between neighboring image swaths easily lead to overall image deterioration. This phenomenon can be seen in shuttle printers in which neighboring printing swaths do, although they receive the same image input, not always print at the same density. When this phenomenon appears, banding is seen in the final image. Also in page wide printers, the printout from neighboring printing units does not always have exactly the same density although all printing units are activated by the same digital image input. This leads again to the problem of uneven density and banding in the final image.

Thus there is still a need for further improved large format printing devices making it possible to print at elevated speed with no or very low banding.

OBJECTS AND SUMMARY OF THE INVENTION

It is an object of the invention to provide a printer for high speed printing of large format images with good image quality.

It is a further object of the present invention to provide a printer, printing large format images with a high printing speed, using dry printing methods and toner particles.

It is still a further object of the present invention to provide a printer, printing large format images with a high printing speed, without banding or problems of density variations.

It is a further object of the present invention to provide a printer for printing large format images at high printing speed with good long term stability and reliability.

Further objects and advantages of the invention will become clear from the description hereinafter.

The objects of the invention are realized by providing a single pass printer, having

- a printing width (PW) for printing a toner image on a substrate, the substrate having a width (WS) and a length (LS), comprising
- a charged toner conveyer, CTC, with a length, $L_{CTC}$, parallel to said printing width, carrying charged toner particles on its surface and coupled to a voltage source so as to create a flow of charged toner particles from said surface towards said substrate,
- a printhead structure with an array of printing apertures and control electrodes associated therewith, said printhead structure being positioned between said CTC and said substrate and said control electrodes being coupled to a second voltage source arranged so as to image-wise modulate said flow of charged toner particles, wherein
  - said array of printing apertures has a length, $L_A$, parallel to said printing width and equal to or larger than said printing width, PW,
  - said length, $L_{CTC}$, is equal to or larger than said length $L_A$ and
- a number n, equal to or larger than 2, of toner applicators on said CTC are provided, each of said means including a container for developer, said container having an active portion and a width $PWE_i$, in a direction of a longitudinal axis parallel to said length $L_{CTC}$, smaller than said length $L_{CTC}$, said number n being chosen such that $$\sum_{i=1}^{i=n} PWE_i \geq L_A, \text{ characterized in that}$$

characterized in that i) a single central conditioning unit for controlling and monitoring the condition of the developer is provided, and ii) said central conditioning unit is equipped with means for circulating said developer to all of said n toner applicators and back to said central unit.

Preferably said printing width is at least 40 cm, and said longitudinal axes are essentially parallel.

DETAILED DESCRIPTION OF THE INVENTION

Definitions

Figure 1:
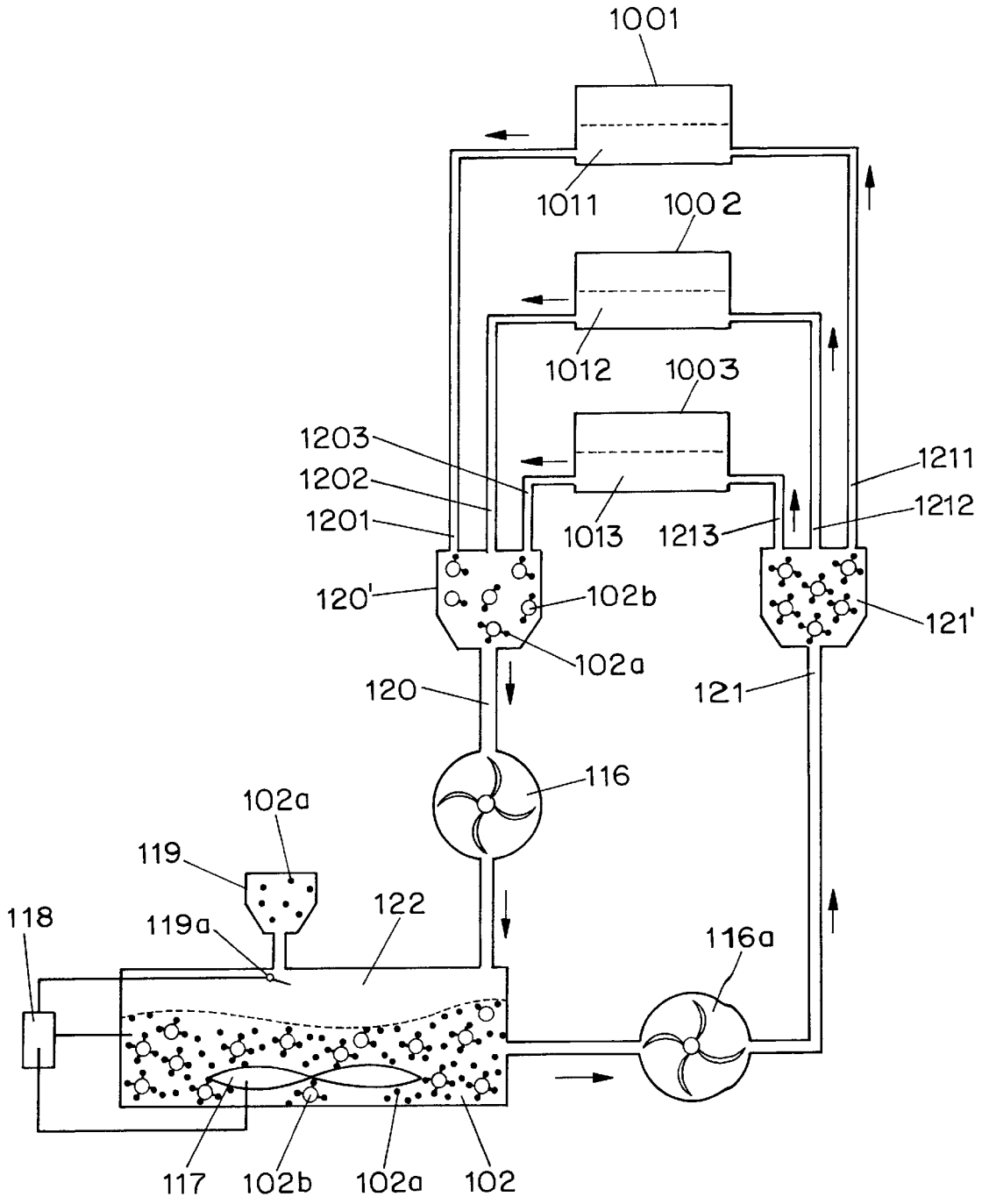
FIG. 1 is a schematic illustration of a large format single pass printer with at least 2 toner applicators to a CTC with length $L_{CTC}$ and with a central conditioning unit according to the present invention.

In this document "central conditioning unit", is used to describe a unit wherein the condition of the developer is monitored, controlled and wherein the condition of the developer (especially with respect to the concentration and the charge of the toner) is kept constant during printing.

The wording "toner applicator" is used for the means for applying charged toner particles to a CTC (Charge Toner Conveyor)

The abbreviation "CTC" is used to indicate the conveyor for charged toner particles. This conveyor can have any form, e.g., it can be a roller, a belt, etc., and has a surface carrying charged toner particles that can move in a electric field from said surface to the substrate to be printed.

The wording "active portion of container for developer" is used to indicate the portion of the container wherein either the sleeve of the magnetic brush, (in a DEP printer wherein the charged toner particles are brought to the surface of the CTC by a magnetic brush from a developer containing magnetic particles), or the surface dispensing roller, (in a DEP printer wherein the charged toner particles are brought to the surface of the CTC by a non-magnetic mono component developer), are loaded with charged toner particles via direct contact between the toning material and the sleeve or the dispensing roller. In the case of a container for developer with a magnetic brush assembly said active portion is e.g. the portion in the magnetic brush assembly in which developer is jumped to the sleeve of the magnetic brush by, e.g. a rotating transport screw. Additional transport screws or paddles delivering developer to said active portion, but not delivering said developer material directly to said sleeve is the "non-active portion of the container".

In this document the wording "staggered toner applicators" is used to indicate a number of toner applicators (at least two), each of the toner applicators that are positioned in the printer so that the longitudinal of the toner applicators, are basically parallel, but not in line.

The wording "substrate" or "image receiving element" can in this document mean a final image receiving element whereon the toner image is printed, as well as an "intermediate image receiving member" used to accept a toner image and to transfer that image to a final image receiving member.

The width of the image receiving substrate (WS) is the dimension of that substrate that is essentially perpendicular to the direction of movement of the substrate in the printer.

The length of the image receiving substrate (WL) is the dimension of that substrate that is essentially parallel to the direction of movement of the substrate in the printer.

It was found and described in EP-A-849 645, that a fast high resolution DEP (Direct Electrostatic Printing) device for large (large means herein having a surface of at least 0.25 $m^2$ and an image width of at least 30 cm) formats could be built when a printhead structure was used with an array of printing apertures having a length $L_A$ equal to or larger than the printing width PW and when a flow of charged toner particles was created from the surface of a CTC with length, $L_{CTC}$, equal to or larger than said length $L_A$. Said charged toner particles are brought to said surface of said CTC by at least 2, preferably at least 3, toner applicators, each of said toner applicators having a longitudinal axis PWE smaller than said length $L_{CTC}$ and being parallel with said length $L_{CTC}$. The toner applicators are preferably staggered near the CTC and can be positioned so that the longitudinal axes partly overlap. A printer according to this invention can be constructed in such a way that any printing width, from 10 cm up to more than, e.g., 5 meter, can be realized. Preferably a printer according to this invention is manufactured such as to have a printing width (PW) of at least 40 cm, preferably of at least 60 cm and more preferably of at least 120 cm.

A printer according to this invention is a "single pass" printer, i.e. the substrate passes the DEP engine only once. In a single pass printer all the image information is printed in its totality on an area of the substrate being present near the printhead structure and the substrate is moved further on, an a further line is printed, and so on. When the concentration and the charge of the toner brought on the surface of the CTC, by at least two toner applicators, is not constant over the printing time, the amount of charged toner particles that can be brought to the substrate by the printing engine is also fluctuating in the time and place, which leads to reduced image quality. It is known in the art to control and monitor the condition of the developer—i.e. ratio of amount of toner particles to the amount of carrier particles, charge of the toner particles, etc.—and to automatically adapt the developer condition to the image density so that the engine prints, when driven by the same image data, the same optical density level. Means for doing so are disclosed in, e.g., EP-A-785 484, U.S. Pat. No. 5,559,579, EP-A-687 962, U.S. Pat. No. 5,420,617, U.S. Pat. No. 5,231,452, etc.

In the case of a DEP device, wherein n toner applicators, each having a width WPE smaller than the length $L_{CTC}$, are spread over the total length of the CTC so that the total printing width can be printed in a single pass, it must not only be assured that the amount and the charge of the toner particles do remain constant over the printing time within each of the toner applicators, but also that at any moment of the printing in each of the toner applicators the same amount of toner particles is brought to the CTC (Charged Toner Conveyor) and that the (average) charge of the toner particles is also the same. It seems straightforward to implement, in such a printer the teachings concerning the monitoring of the condition of the developer to the developer used in each individual toner applicator separately and have all of said toner applicators bringing the same amount of toner particles, with the same average charge on the CTC. This will the result in the same image density being printed over the total length of the CTC, when driven by the same image data.

During experimentation, it was however found that, in a printer as described immediately above, when the condition of the developer was monitored for each of the toner applicators separately, the printing quality in terms of banding deteriorated with the printing time, due to the fact that the change in developer condition with the time was, in spite of the monitoring of the developer in each of the toner applicators separately, still not the same for all of said applicators.

Further experimentation revealed that when the condition of the developer was controlled in a central conditioning unit, and when all said toner applicators received developer from this central conditioning unit, the image quality reached in a such a printer, did not or almost invisibly change with the printing time.

Thus the use of a central conditioning unit, as in the present invention, did not only simplify the large format single pass printer and make it less expensive and less bulky (without such a central unit every toner applicator needs to have its own developer control and monitoring unit) but did also lead to better image quality that remained unaltered over a longer period of printing.

It was found that for keeping—in a printer as described above—the developer in perfect condition with the aid of a central conditioning unit it was necessary that the developer circulated quite rapidly from the central conditioning unit to the toner applicators and back. Preferably the circulating speed is chosen such that at any moment during printing at most 25% by volume of the developer is present in the active portion of the container for developer in the toner applicators while at least 75% are continuously being circulated through the central conditioning unit for keeping its condition constant.

For keeping the condition of the developer constant, the central conditioning unit can be connected not only to a circuit for circulating developer to all toner applicators but also to a reservoir of fresh toner particles. The connection with said reservoir is equipped with a valve that selectively can be opened and closed depending on the condition of the developer in the central conditioning unit.

Moreover to reduce waste, the toner particles that are not used in the transfer to the substrate, can be recovered and also connected in the central conditioning unit so that these non-used toner particles are recycled instead of simply dumped.

In FIG. 1 a schematic view of a central conditioning unit useful in this invention is shown coupled to three toner applicators (1001, 1002 and 1003). Each of toner applicators comprises a container (1011, 1012 and 1013) for developer from where the toner particles are brought to the CTC (not shown). In the heart of the central unit a container (122) is present wherein the developer (102) containing toner particles (102*a*) and carrier particles (102*b*) can be mixed by one or more mixing means (117). The mixing provides a tribo-electric charge on the toner particles. The container is coupled to inlets (1201, 1202, 1203) over a collection vessel (120') for the developer circulating between the containers for developer of each of the toner applicators and the container (122). Means for moving (116) the developer towards the container are also provided. The means for moving the developer (116, 116*a*) or the non-used toner particles (116*b*) can be any means known in the art, e.g. paddles moved by a motor, pumps, Archimedian screws, etc. The container contains further an outlet (121) coupled to each of the toner applicators, this outlet is also provided with means (116*a*) for moving the conditioned developer towards the various toner applicators using a distribution box (121') through ducts (1211, 1212 and 1213). The container (122) is further coupled to a vessel (119) containing fresh toner particles , said vessel being coupled to said container over valve (119*a*) that can selectively be opened and closed. The container (122) is coupled to means for monitoring the condition of the developer i.e. to means for measuring the ratio of toner to carrier particles (118) and/or the charge of the toner particles. The means for measuring the ratio of toner to carrier particles (118) and/or the charge of the toner particles are coupled to the valve (119*a*) for selectively opening and closing said valve depending on the measured result of the developer condition and the intended one. Optionally said means for measuring the ratio of toner to carrier particles (118) and/or the charge of the toner particles can be coupled to the mixing means (117) so that also the mixing can be used to control the charge of the toner particles to a predetermined constant value. The means for moving (116, 116*b*) the non-used toner particles and the developer from the toner applicators towards the container and the means (116*a*) for moving the conditioned developer from the central conditioning unit towards the various toner applicators are equipped for giving such a circulating speed to the developer that at any moment during printing at most 25% by volume of the developer is present in the active portion of the container for developer in (1011, 1012 and 1013) the toner applicators while at least 75% are continuously being circulated through the central conditioning unit for keeping its condition constant. The ducts connecting the central conditioning unit with the various toner applicators can be made from rigid material as well as of flexible material. It is preferred to use ducts in flexible polymeric material.

Figure 2:
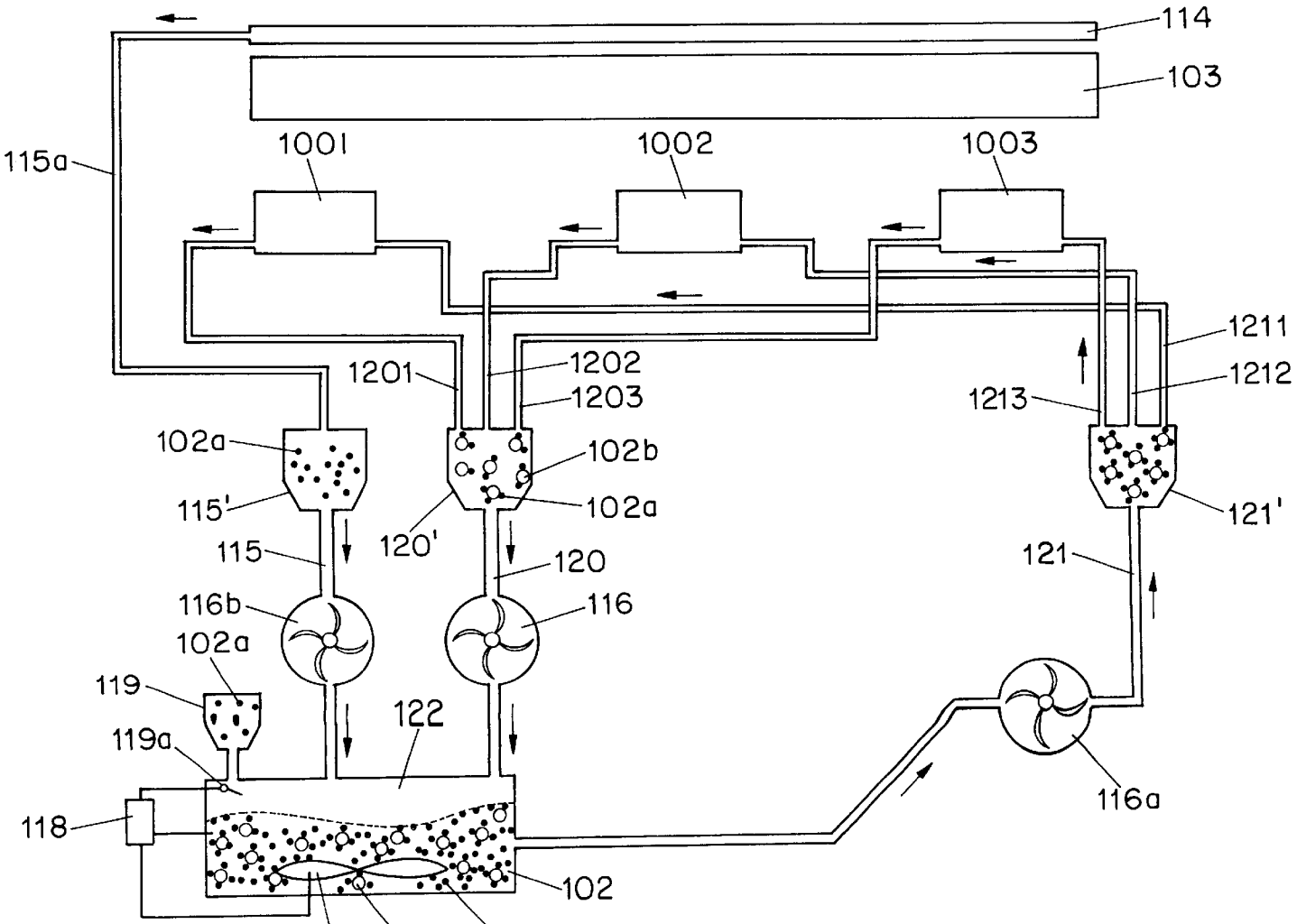
FIG. 2 shows schematically an other embodiment of a large format single pass printer with at least 2 printing engines and with a central conditioning unit according to the present invention.

In FIG. 2, a schematic view of a central conditioning unit useful in this invention is shown coupled to three toner applicators (1001, 1002 and 1003) each of these applicators being coupled to a single CTC (103). In this figure the CTC is equipped with means (114) for collecting non used toner particles; by doing so the amount of waste during printing is minimized. The central conditioning unit is coupled to said means for collecting the non-used toner particles using a collection vessel (115') through a duct (115). Means (116*b*) are provided to bring the non-used toner particles from the printing engines to the container (122) in the central conditioning unit, wherein the non-used toner particles are mixed with the circulating developer and used again.

This is a preferred embodiment of this invention.

The distribution box (121') can be omitted and the separate ducts (1211, 1212 and 1213) can originate directly from the container (122) of the central unit for controlling and monitoring the developer. Also the collection vessels (115' and 120') can be omitted and the inlets (115, 1201, 1202 and 1203) can be connected directly to the container (122) of the central unit for controlling and monitoring the developer. It is also possible to omit collection vessel 115' and guiding the non-used toner particles directly into the ducts for circulating the developer. By doing so the total printer is simplified as the means for moving the non-used toner particles to the central conditioning unit can also be omitted.

Figure 3:
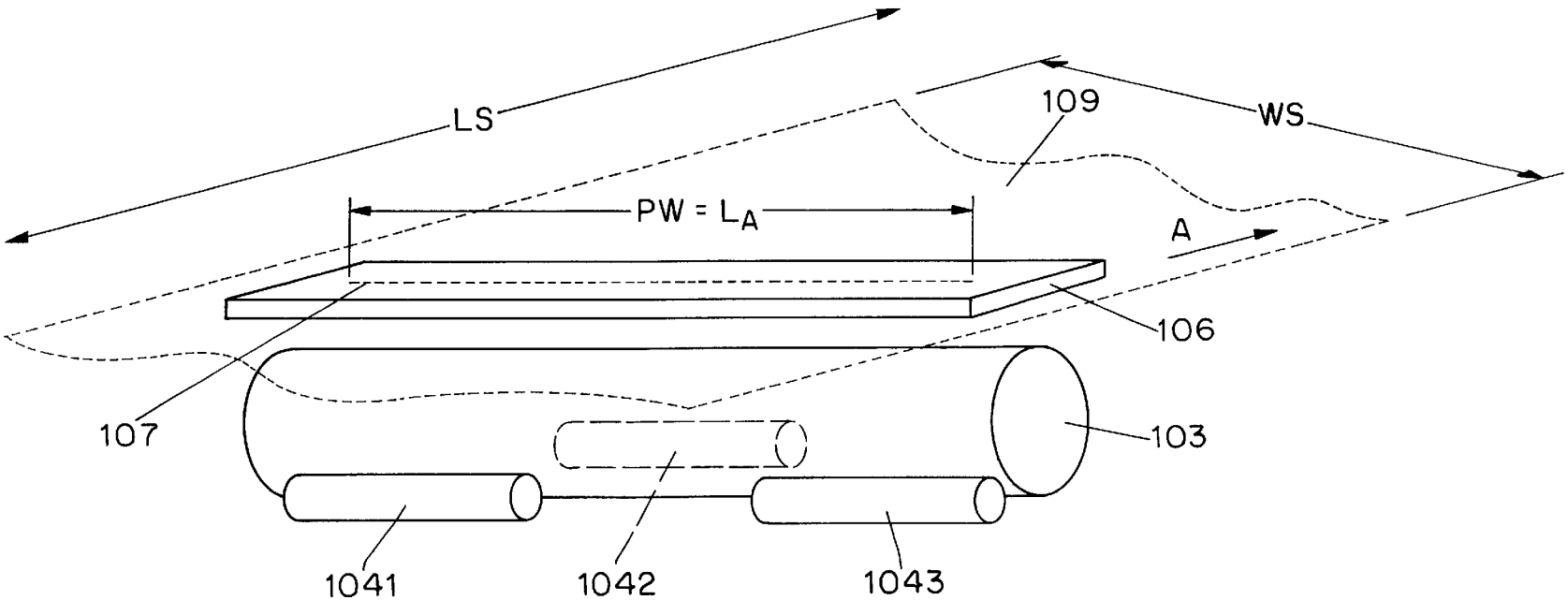
FIG. 3 shows schematically a large format single pass printer that can be equipped with a central conditioning unit according to the present invention.

In FIG. 3 a schematic perspective view of a printer with a printing width (PW) for printing a toner image on a substrate (109), having a width (WS) and a length (LS) and traveling in the direction of arrow A, is shown. (in FIG. 3. the substrate is shown as transparent for the sake of clarity). It comprises a charged toner conveyer, CTC, (103) with a length, $L_{CTC}$, parallel to said printing width, a printhead structure (106) with an array of printing apertures (107), having a length, $L_A$, parallel to said printing width and—in FIG. 3—equal said printing width, PW, wherein said length, $L_{CTC}$, is equal to or larger than said length $L_A$ and 3 toner applicators (1041, 1042, 1043) in a staggered configuration near said CTC. The toner applicators have a width $PWE_i$, in a direction of a longitudinal axis parallel to said length $L_{CTC}$, smaller than said length $L_{CTC}$. The respective width of the toner applicators and the number, n, of toner applicator and an optional overlap of some or all of the toner applicators, is chosen in such a way that the desired printing width (PW), preferably larger than 40 cm, is reached, therefore said number n is chosen such that $$\sum_{i=1}^{i=n} PWE_i \geq L_A.$$

It is preferred that the respective longitudinal axis of the respective toner applicators are essentially parallel to each other and to the width of the substrate. In FIG. 3, the combination of a printhead structure and toner applicators staggered near a CTC is considered as a printing engine. A printer for printing four colors, e.g., yellow, magenta, cyan and black (YMCK), will thus comprise four printing engines as shown in FIG. 3.

In such a printer the toner applicators for each of the printing engines are preferably coupled to a central unit for controlling and monitoring the developer according to this invention.

Figure 4:
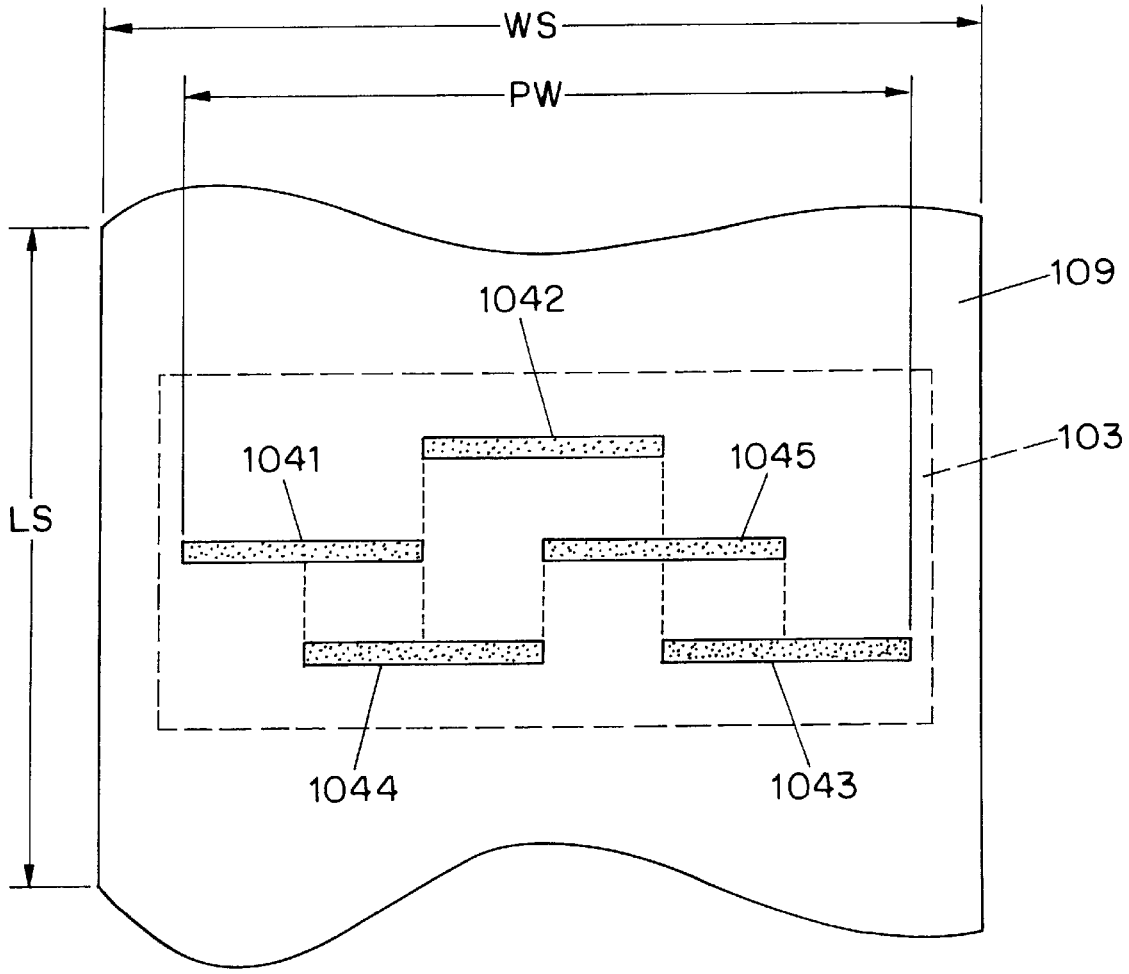
FIG. 4 shows schematically a large format single pass printer with at least 2 toner applicators staggered near a CTC equipped with a central conditioning unit according to the present invention.

In FIG. 4 a schematic perspective view of a further large format single pass printer that beneficially can be equipped with a central conditioning unit according to this invention is shown. In this printer a more complex set of five toner applicators (e.g., five magnetic brush assemblies) is used to bring charged toner particles to the CTC (103). A projection of the five toner applicators (1041, 1042, 1043, 1044, 1045) and the CTC (103) in the plane of the large substrate (109), having a width (WS) and a length (LS) is shown in FIG. 4.

The substrate and the CTC are shown as transparent for showing the 5 toner applicators. Three of toner applicator means (1041, 1042 and 1043) are positioned in a staggered configuration, without overlap, so as to obtain an homogeneous toner density upon the charged toner conveyor. Two extra toner applicator modules (1044 and 1045) are staggered with respect to the first set of three toner applicator modules, with a certain overlap, so that charged toner particles are applied to the center of the charged toner conveyor from two separate toner applicator modules. I.e. toner applicator module 1044 overlaps for 50% with both toner module 1041 and 1042 and toner applicator module 1045 overlaps 50% with both toner module 1042 and 1043. It was found that this arrangement results in an even better homogeneity of the charged toner layer thickness upon the charged toner conveyor. The extension of the set of toner delivery means gives the printing width (PW) of the printer.

Figure 5:
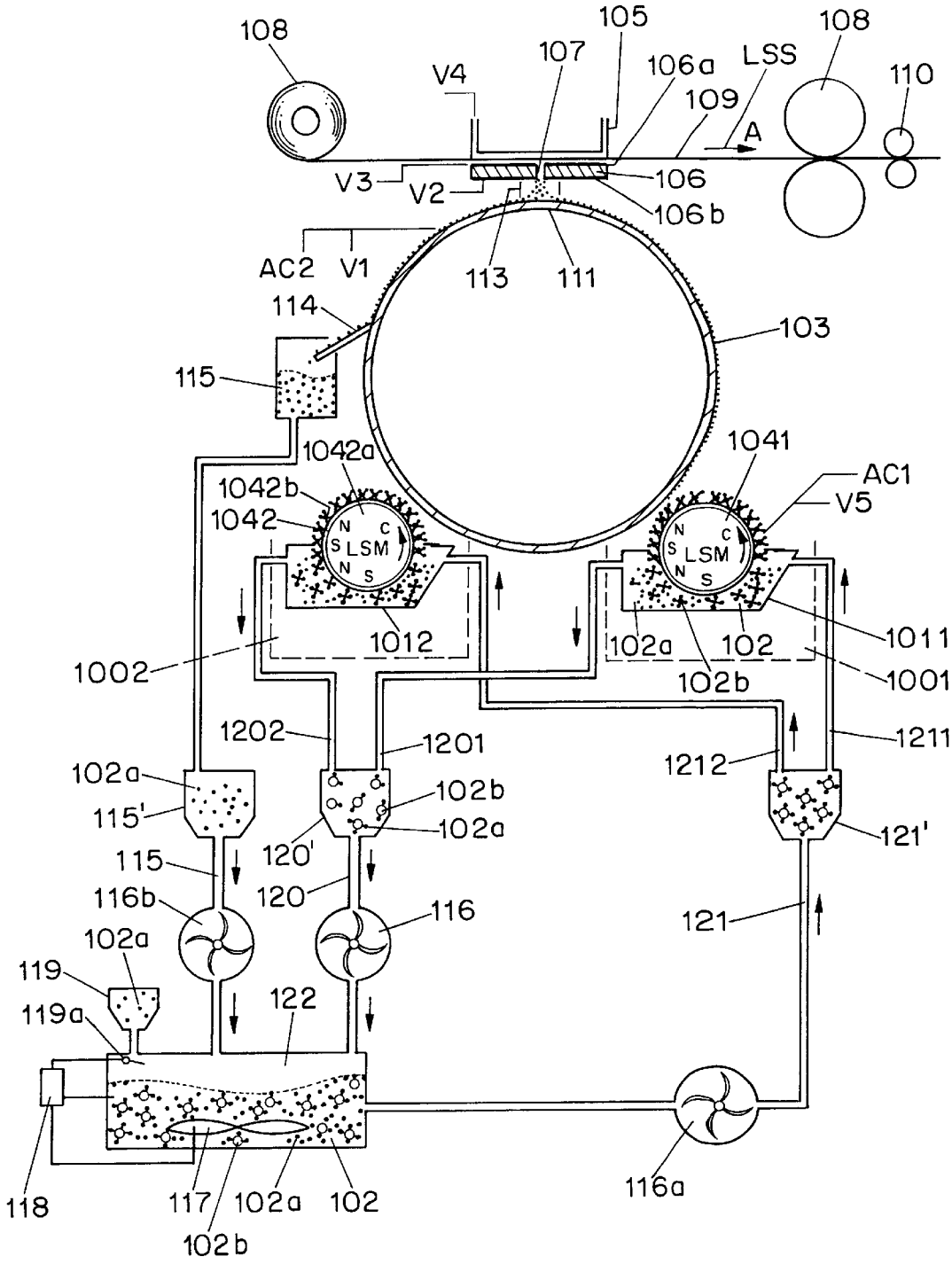
FIG. 5 shows schematically a large format single pass printer with a shuttle using a large format DEP device wherein near a single CTC at least two toner applicators are present and that can be equipped with central conditioning units according to this invention.

A schematic, non-limitative, example of a large format printer incorporating a central conditioning unit according to this invention and having a charged toner conveyer, CTC, (103) with a length, $L_{CTC}$, parallel to said printing width, a printhead structure (106) with an array of printing apertures (107), having a length, $L_A$, parallel to said printing width and equal to or larger than said printing width, PW, wherein said length, $L_{CTC}$, is equal to or larger than said length $L_A$ and at least two toner applicators in a staggered configuration near said CTC is shown in FIG. 5. This figure shows a schematic cross-section in a plane perpendicular to the length of the CTC and the printing width. The printer comprises means (108) for moving a substrate (109) to be printed in the direction of arrow A at linear speed LSS, and means for fixing (110) the toner image to the substrate. On the first side of the substrate a back electrode (105) kept at a DC-voltage (V4) is present. On the second side of the substrate, two toner applicators (1001 and 1002) are present wherein a population of charged toner particles, is generated in container (1011 and 1012) with a magnetic brush assembly (1041, 1042), with a non-magnetic sleeve (1041*b*, 1042*b*) and a magnetic core (1041*a*, 1042*a*). Since both the toner applicators are identical in this figure the numericals indicating the core and sleeve and the voltage source are for sake of clarity only shown with one toner applicator. By means of a DC-field (V5) and/or an AC-field (AC1), charged toner particles are jumped from said sleeve (1041*b*) of the magnetic brush (1041), rotating in the direction of arrow C with a linear surface speed, LSM to the surface (103*a*) of the Charged Toner Conveyer (CTC) (103), that has a radius R and that rotates in the direction of arrow B at a linear surface speed. The surface of the CTC is kept at a DC voltage (V1) and/or an AC voltage (AC2). The DC voltage (V1) on the surface of the CTC is different from the DC voltage (V4) on the back electrode. Thus a propulsion field is created between the surface of the CTC and the back electrode wherein a flow (111) of charged toner particles from the CTC to the back electrode is created. A printhead structure (106) comprising printing apertures (107) and a common shield electrode (106*b*) is placed in that flow. The surface of the CTC is moved near the printing apertures (107) to bring said charged toner particles in the development zone (113). This development zone is the space between the surface of the CTC and printhead structure wherein the propulsion field creates said flow (111) of toner particles towards an image receiving member (109) to be printed. Around each printing aperture a control electrode is present, applying an image-wise varying DC voltage (V3) to control electrodes (106*a*) around the printing apertures, the strength of the propulsion field can be changed so as to let said charged toner particles image-wise pass the printing apertures. The remaining charged toner particles are further displaced downstream of the printing zone to a cleaning station (114, 115) in which the non-used toner particles are completely removed from the surface of said CTC to have a bare surface again. Then the CTC moves further on towards the magnetic brushes, located upstream of the development zone where again a fresh population of charged toner particles, wherein no wrong sign toner particles are present, is provided on the surface of the CTC. During printing developer is circulated from the container (122) of the central conditioning unit to the containers for developer (1011, 1012) of each of the printing engines by means (116, 116*a*, 116*b*) for moving the developer through outlet (121) and distribution box (121') and from said containers for developer (101) back to the container (122) in the central conditioning unit through outlets (120) in the containers (101) and collecting box (120'). The means for moving the developer are equipped so as to have at any moment during printing at most 25% by volume of the developer is present in the active portion of the containers (1011, and 1012) of the toner applicators while at least 75% are continuously circulated through the central conditioning unit for keeping its condition constant. The container (122) is further coupled to a vessel (119) containing fresh toner particles , said vessel being coupled to said container over valve (119*a*) that can selectively be opened and closed. The container (122) is coupled to means for monitoring the condition of the developer i.e. to means for measuring the ratio of toner to carrier particles (118) and/or the charge of the toner particles. The means for measuring the ratio of toner to carrier particles (118) and/or the charge of the toner particles are coupled to the valve (119*a*) for selectively opening and closing said valve depending on the measured result and the intended one. Optionally said means for measuring the ratio of toner to carrier particles (118) and/or the charge of the toner particles can be coupled to the mixing means (117) so that also the mixing can be used to control the charge of the toner particles to a predetermined constant value.

The non-used toner particles that have been removed by collecting means (114, 115) from the CTC are recycled to the single central conditioning unit by means (116*b*) for moving the non-used toner over a collecting box (115').

The location and/or form of the shield electrode (106*b*) and the control electrode (106*a*) can, in other embodiments of a device for a DEP method using toner particles according to the present invention, be different from the location shown in FIG. 5.

Although in FIG. 5 an embodiment of a device for a DEP method using two electrodes (106*a* and 106*b*) on printhead 106 is shown, it is possible to implement a DEP method, using toner particles according to the present invention using devices with different constructions of the printhead (106). It is, e.g. possible to implement a DEP method with a device having a printhead comprising only one electrode structure as well as with a device having a printhead comprising more than two electrode structures. The apertures in these printhead structures can have a constant diameter, or can have a broader entrance or exit diameter.

The back electrode (105) of this DEP device can also be made to co-operate with the printhead structure, said back electrode being constructed from different styli or wires that are galvanically isolated and connected to a voltage source as disclosed in e.g. U.S. Pat. No. 4,568,955 and U.S. Pat. No. 4,733,256. The back electrode, co-operating with the printhead structure, can also comprise one or more flexible PCB's (Printed Circuit Board).

Between said printhead structure (106) and the charged toner conveyer (103) as well as between the control electrode around the apertures (107) and the back electrode (105) behind the toner receiving member (109) as well as on the single electrode surface or between the plural electrode surfaces of said printhead structure (106) different electrical fields are applied. In the specific embodiment of a device, useful for a DEP method, using a printing device with a geometry according to the present invention, shown in FIG. 5. voltage V1 is applied to the sleeve of the charged toner conveyer 103, voltage V2 to the shield electrode 106*b*, voltages V30 up to $\mathbf{V3}_n$ for the control electrode (106*a*). The value of V3 is selected, according to the modulation of the image forming signals, between the values $\mathbf{V3}_0$ and $\mathbf{V3}_n$, on a time basis or gray-level basis. Voltage V4 is applied to the back electrode behind the toner receiving member. In other embodiments of the present invention multiple voltages $\mathbf{V2}_0$ to $V^2_n$ and/or $\mathbf{V4}_0$ to $\mathbf{V4}_n$ can be used. Voltage V5 is applied to the surface of the sleeve of the magnetic brush.

In a DEP device according to the present invention an additional AC-source can beneficially be connected to the sleeve of said magnetic brush.

The magnetic brush (1041, 1042) preferentially used in a DEP device according to the present invention is of the type with stationary core and rotating sleeve.

In a DEP device, according to a preferred embodiment of the present invention, any type of known carrier particles and toner particles can successfully be used. It is however preferred to use "soft" magnetic carrier particles. "Soft" magnetic carrier particles useful in a DEP device according to a preferred embodiment of the present invention are soft ferrite carrier particles. Such soft ferrite particles exhibit only a small amount of remanent behavior, characterized in coercivity values ranging from about 4 kA/m up to 20 kA/m (50 up to 250 Oe). Further very useful soft magnetic carrier particles, for use in a DEP device according to a preferred embodiment of the present invention, are composite carrier particles, comprising a resin binder and a mixture of two magnetites having a different particle size as described in EP-B 289 663. The particle size of both magnetites will vary between 0.05 and 3 $\mu$M. The carrier particles have preferably an average volume diameter ($d_{v50}$) between 10 and 300 $\mu$m, preferably between 20 and 100 $\mu$m. More detailed descriptions of carrier particles, as mentioned above, can be found in EP-A-675 417.

It is preferred to use in a DEP device according to the present invention, toner particles with an absolute average charge over mass ratio ($|q/m|$) corresponding to $5\ \mu C/g \leqq |q/m| \leqq 15\ \mu C/g$, preferably to $8\ \mu C/q \leqq |q/m| \leqq 11\ \mu C/g$. The charge to mass ratio of the toner particles is measured by mixing the toner particles with carrier particles, and after 15 min of charging the q/m-ratio is measured with a device such as the Toshiba TB-200 blow-off tester. In this disclosure the charge to mass ratio is taken as the absolute value, as a DEP device according to this invention can function either with negatively charged toner particles or with positively charged toner particles depending on the polarity of the potential difference between V1 and V4. Preferably the toner particles used in a device according to the present invention have an average volume diameter ($d_{v50}$) between 1 and 20 $\mu$m, more preferably between 3 and 15 $\mu$m. More detailed descriptions of toner particles, as mentioned above, can be found in EP A 675 417 that is incorporated herein by reference.

It is preferred in large format printers using at least two toner applicators coupled to a central conditioning unit according to this invention, not-only to prevent changes in toner concentration in the different printing units, but also to use toner particles with a narrow charge distribution, i.e. the charge of the toner particles shows a distribution wherein the coefficient of variability (v), i.e. the ratio of the standard deviation to the average value, is equal to or lower than 0.4 preferably lower than 0.3. The charge distribution of the toner particles is measured by an apparatus sold by Dr. R. Epping PES-Laboratorium D-8056 Neufahrn, Germany under the name "q-meter. In, e.g., U.S. Pat. No. 5,569,567, U.S. Pat. No. 5,622,803 and U.S. Pat. No. 5,532,097 it is disclosed how to prepare both negatively and positively chargeable toner particles with narrow charge distribution. It is a preferred embodiment of the invention to use toner particles prepared according to the method described in these disclosures.

A DEP device making use of the above mentioned marking toner particles can be addressed in a way that enables it to give black and white. It can thus be operated in a "binary way", useful for black and white text and graphics and useful for classical bi-level half-toning to render continuous tone images.

A large format printer according to this invention using DEP devices is especially suited for rendering an image with a plurality of gray levels. Gray level printing can be controlled by either an amplitude modulation of the voltage V3 applied on the control electrode 106*a* or by a time modulation of V3. By changing the duty cycle of the time modulation at a specific frequency, it is possible to print accurately fine differences in gray levels. It is also possible to control the gray level printing by a combination of an amplitude modulation and a time modulation of the voltage V3, applied on the control electrode.

The combination of a high spatial resolution and of the multiple gray level capabilities typical for DEP, opens the way for multilevel half-toning techniques, such as e.g. described in EP-A-634 862 with title "Screening method for a rendering device having restricted density resolution". This enables the DEP device, according to the present invention, to render high quality images.

The embodiment of a large format printer with a central development unit according to this invention as schematically shown in FIG. 5, i.e. wherein the printing proceeds with toner applicators bringing charge toner particles to the charged toner conveyor (CTC) from a two-component developer comprising magnetic carrier particles and non-magnetic toner particles and wherein the non-used toner particles are recycled in the printing process is the most preferred embodiment of the invention. In an other preferred embodiment of the present invention the outlet of developer in the individual toner applicators (1201, 1202, 1203) is used as transportation help in the recovery system for non-used toner, thus the duct (115) for non-used toner is led in the outlet of developer in the individual toner applicators (1201, 1202, 1203) so that said recovered toner particles can be transported to said central conditioning station with the aid of said developer material that also has to be transported to said central conditioning unit. It is equally well suitable to lead the outlets of developer in the individual toner applicators (1201, 1202, 1203) directly to the collecting means (114, 115) of the different printing units and transporting said combined used developer and recuperated toner to said central conditioning unit.

Nevertheless large format printers with a central conditioning unit according to this invention wherein the non-used toner particles are not recycled and only the developer is circulated from the central conditioning unit to the printing engines and back are within the scope of the present invention.

Figure 6:
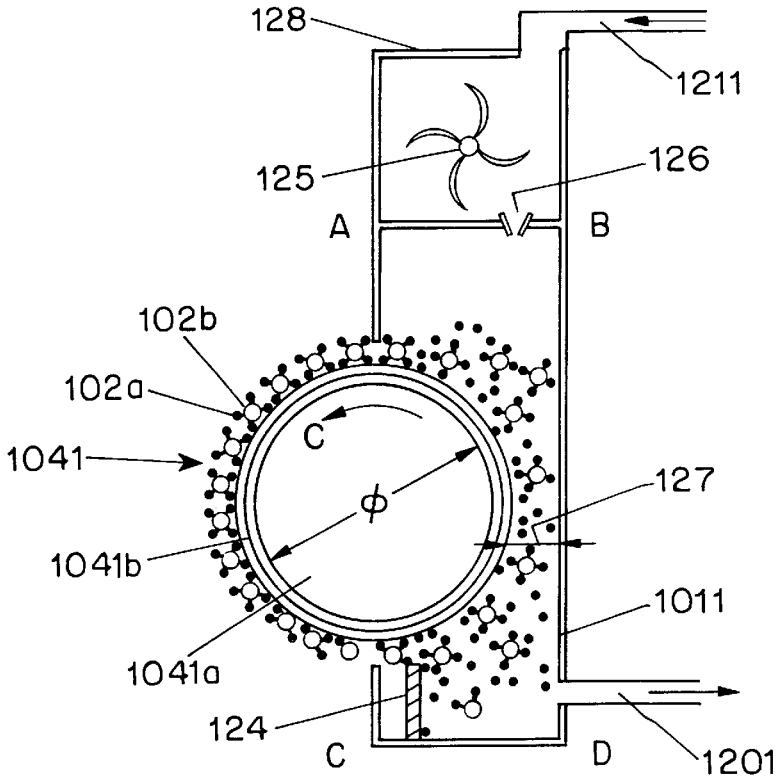
FIG. 6 is a schematic cross-section of a compact toner applicator useful in this invention.

Also large format printers with a central conditioning unit according to this invention (in which toner particles are conditioned and/or pre-charged) toner applicators with non-magnetic mono-component developer bringing charged toner particles to the CTC, are within the scope of the present invention. The use of magnetic brushes, combined with a two-component developer comprising non-magnetic toner particles and magnetic carrier particles, as toner applicators bringing charged toner particles to the CTC is however a very preferred embodiment of this invention A further advantage of using a central conditioning unit to feed developer to the toner applicators is the fact that the toner applicator can be made very small with a container for developer that in fact is almost not larger than the active zone of the applicator, i.e. the housing of the applicator determines the "active zone". In FIG. 6, such a toner applicator is shown in cross-section. The container (1011) is equipped with an inlet (1211) and an outlet (1201) for developer. In the container a magnetic brush (1041) is present with a magnetic core (1041*a*) and a non-magnetic sleeve (1041*b*), the magnetic brush has a diameter $\phi$ measured from one surface of the sleeve to the other. The developer (102) is a two component developer comprising non-magnetic toner particles (102*a*) and magnetic carrier particles (102*b*). In the container a partition (128) is provided wherein the conditioned developer is brought and an Archimedean screw (125) forwards the developer over the length of the magnetic brush, from the partition 128) the developer comes into the container and at a nip (127) the developer is brought to the magnetic brush, rotating in direction of arrow C. A metering blade (124) regulates the amount of developer brought onto the sleeve of the magnetic brush.

In a small toner applicator used in a printer according to this invention in connection with a central conditioning unit for de developer the area of the cross-section of the magnetic brush (1041), perpendicular to the length of the magnetic brush ($area_{MB}$) and the area of the container ($area_{CONT}$) for developer (1011) in the cross-section perpendicular to the length of the magnetic brush—without the partition (128)—relate to each other as $area_{MB}/area_{CONT} \geqq 0.3$. $Area_{CONT}$ is the area of the rectangle ABCD, minus the area of that part of the magnetic brush extending in the container.

In such a small toner applicator the magnetic brush has further preferably a diameter equal to or smaller than 30 mm.

Figure 7:
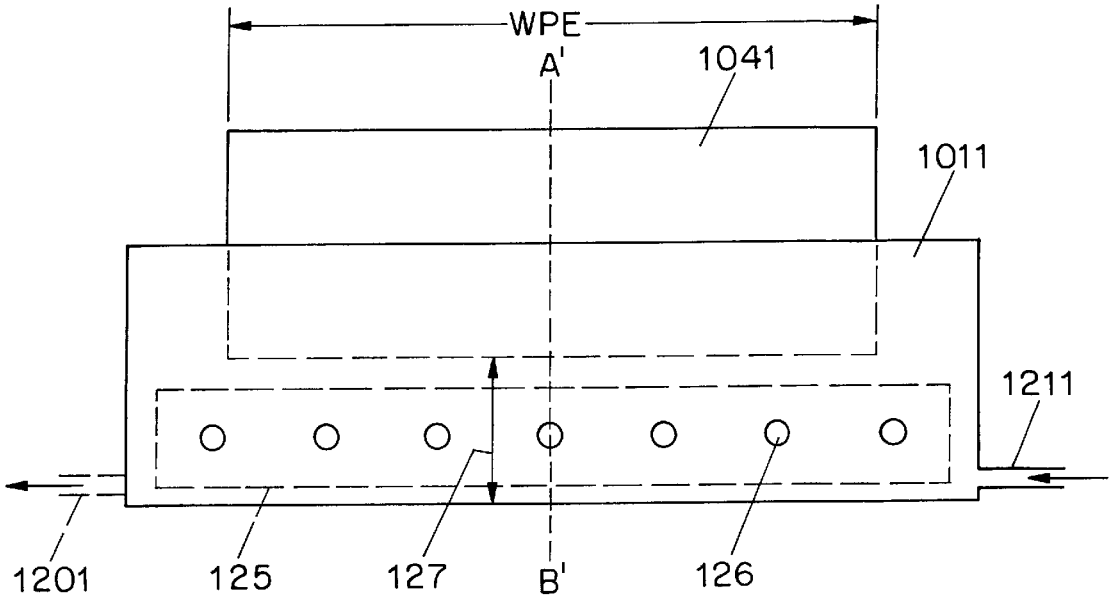
FIG. 7 is a schematic top-view of a compact toner applicator useful in this invention.

In FIG. 7, a top-view of a small toner applicator as shown in FIG. 6 is shown. The cross-section shown in FIG. 6 is a cross-section through the plane A'–B' of FIG. 7. The numericals are the same as used for FIG. 6.

Thus the present invention encompasses a toner applicator having a container and a magnetic brush assembly therein, the area of the cross-section of the magnetic brush (1041), $AREA_{MB}$ and the area of the container, $AREA_{CONT}$ for developer (1011), both area measured in the cross-section perpendicular to the length of the magnetic brush, relate to each other as $area_{MB}/area_{CONT} \geqq 0.3$. Preferably said toner applicator comprises a magnetic brush with a diameter equal to or smaller than 30 mm.

A large format printer as described above can also be incorporated in a shuttle printer. By doing so, a large format printer with a moving shuttle having, preferably, a printing width (swath width SWS) of at least 30 cm, more preferably larger than 40 cm, so that a large format image is written in separate image bands (swaths) can be made. The shuttle comprises then a DEP engine with a large CTC and at least two toner applicators staggered near said CTC for bringing charged toner particles to the CTC. The shuttle, comprising a DEP printing engine, is traveling over the image receiving member in a first direction, preferably a direction that is essentially parallel to the width of the substrate to be printed, thus perpendicular to the length of the substrate. After having printed a single band over the width of the image receiving member, the image receiving member is moved in a direction different from said first direction, over a length corresponding to the width of the printhead structure and toner delivering means. Thus, the invention encompasses a printer for large format printing, wherein a large substrate is movable in one direction and a shuttle comprising a DEP printing engine is movable in a second direction, the second direction being different from the first direction, the DEP printing engine comprising a printhead structure (106) comprising printing apertures (107) and control electrodes (106"), and a CTC (103) and wherein at least two toner applicator modules (1041, 1042) are positioned in a staggered configuration near the CTC.

In a moving shuttle-type printer wherein the shuttle has a wide printing width and carries a DEP device with a single large CTC and at least two toner applicators so that a large format image is written in separate image bands (swaths), can be implemented with a central conditioning unit according to this invention when the toner applicators on the shuttle, printing the same color, are coupled to a central conditioning unit. An implementation according to the present invention has the additional benefit that said moving shuttle system does not need multiple heavy developer supplies, so that its movement can be made less complicated and less expensive thanks to said central conditioning unit that can be placed on the moving parts of the shuttle printer, but preferably it is NOT placed upon said moving parts of said shuttle type printer. The shuttle is traveling over the image receiving member (substrate) in a first direction, preferably a direction that is essentially parallel to the width of the substrate to be printed. After having printed a single band over the width of the substrate, the substrate is moved in a direction different from said first direction, over a length corresponding to the width of the printhead structure and toner delivering means.

A printer wherein the shuttle comprises a DEP engine according to this invention with a central developer conditioning unit and wherein said DEP engine has a printing width of at least 30 cm, preferably of at least 40 cm, more preferably 60 cm, can be used for printing very large formats. For printing very large substrate in a short printing time, the DEP engine on the shuttle can be constructed with a printing width of at least 120 cm so that a swath with a width of 120 cm is printed with one shuttling of the shuttle over the width of the substrate to be printed. This is different from the shuttling printers known in the art while by a shuttle of this invention broader bands can be printed. This means that even with a fairly low shuttling speed of the printer a large format print can be made in a short time. Such a shuttling printer can very beneficially be used for printing images of very large dimension (e.g. >5 meter width) with a very high printing speed (e.g. >500 $m^2$/hour).

A shuttle according to the present invention can, e.g., comprise three toner applicators with a width of, e.g., 0.3 m, staggered and mounted around a CTC of 90 cm. Such a printer makes it possible, when the shuttling proceeds with the longest dimension of the shuttling printer (i.e. in this example 0.9 m width) perpendicular to the width of the large substrate, to print in one shuttle movement a band that is 0.9 m wide. It is clear that such a shuttle can be constructed with less or more DEP engines, with wider or smaller engines, etc., without going beyond the scope of this invention.

EXAMPLES

Throughout the printing examples, the same developer, comprising toner and carrier particles was used.

The Carrier Particles

A macroscopic "soft" ferrite carrier consisting of a MgZn-ferrite with average particle size 50 $\mu$m, a magnetization at saturation of 36 $\mu Tm^3/kg$ (29 emu/g) was provided with a 1 $\mu$m thick acrylic coating. The material showed virtually no remanence.

The Toner Particles

The toner used for the experiment had the following composition: 97 parts of a co-polyester resin of fumaric acid and bispropoxylated bisphenol A, having an acid value of 18 and volume resistivity of $5.1\times10^{16}$ ohm.cm was melt-blended for 30 minutes at 110° C. in a laboratory kneader with 3 parts of Cu-phthalocyanine pigment (Color Index PB 15:3). A resistivity decreasing substance—having the following formula: $(CH_3)_3N^+C_{16}H_{33}\ Br^-$ was added in a quantity of 0.5% with respect to the binder, as described in WO-A-94/027192.

After cooling, the solidified mass was pulverized and milled using an ALPINE Fliessbettgegenstrahlmühle type 100AFG (trade name) and further classified using an ALPINE multiplex zig-zag classifier type 100MZR (trade name). The average particle size was measured by Coulter Counter model Multisizer (trade name), was found to be 6.3 $\mu$m by number and 8.2 $\mu$m by volume. In order to improve the flowability of the toner mass, the toner particles were mixed with 0.5% of hydrophobic colloidal silica particles (BET-value 130 $m^2/g$)

The Developer

An electrostatographic developer was prepared by mixing said mixture of toner particles and colloidal silica in a 9% ratio (wt/wt) with carrier particles. The triboelectric charging of the toner-carrier mixture was performed by mixing said mixture in a standard tumbling set-up for 10 min. The developer mixture was run in the magnetic brush for 5 minutes, after which the toner was sampled and the triboelectric properties were measured using the Toshiba TB-200 blow-off device, resulting in a q/m-ratio of −14 $\mu$C/g.

The Printhead Structure (106)

A printhead structure (106) was made from a polyimide film of 50 $\mu$m thickness, double sided coated with a 5 $\mu$m thick copper film. The printhead structure (106) had two rows of printing apertures. The rows of printing apertures had a length, $L_A$ of 90 cm. On the back side of the printhead structure, facing the image receiving member, a rectangular shaped control electrode (106*a*) was arranged around each aperture. Each of said control electrodes was connected over 2 MΩ resistors to a HV 507 (trade name) high voltage switching IC, commercially available through Supertex, USA, that was powered from a high voltage power amplifier. The printing apertures were rectangular shaped with dimensions of 360 by 120 $\mu$m. The dimension of the central part of the rectangular shaped copper control electrodes was 500 by 260 $\mu$m. The apertures were spaced so to obtain a resolution of 33 dots/cm (85 dpi). On the front side of the printhead structure, facing the charged toner conveyer roller, a common shield electrode (106*b*) was arranged around the aperture zone leaving a free polyimide zone of 1620 $\mu$m. Said printhead structure was fabricated in the following way. First of all the control and shield electrode pattern was etched by conventional copper etching techniques. The apertures were made by a step and repeat focused excimer laser making use of the control electrode patterns as focusing aid. After excimer burning the printhead structure was cleaned by a short isotropic plasma etching cleaning. Finally a thin coating of PLASTIK70, commercially available from Kontakt Chemie, was applied over the control electrode side of said printhead structure.

Container for Developer

A large container for developer was used equipped with mixing means so that 20 kg of developer was constantly shaken. A smaller amount of developer was pumped by transport screws to the individual magnetic brush assemblies. No toner monitoring device was present in said container for developer. Regulation of said toner concentration was done by calculating the amount of toner printed from the image signals and adding an amount of 102% of said calculated removed toner concentration. (It was found that about 2% of said calculated toner amount "disappeared" in the printing process).

The Charged Toner Conveyer (CTC)

The CTC, with length $L_{CTC}$ of 100 cm, was a cylinder with a sleeve made of aluminum, coated with TEFLON (trade name of Du Pont, Wilmington, USA) with a surface roughness of 2.2 $\mu$m (Ra-value) and a diameter of 30 mm. The charged toner conveyer (103) was connected to an AC power supply (AC1) with a square wave oscillating field between 1750 V peak to peak at a frequency of 3.0 kHz with +50 V DC-offset. Said CTC was equipped with a stainless steel scraper blade removing all remaining toner particles from said CTC-surface and collecting said removed toner particles by means of a developer transport to a single container for developer.

Magnetic Brush Assembly (MB)

Charged toner particles were propelled to this conveyer from three stationary core/rotating sleeve type magnetic brushes comprising two mixing rods and one metering roller. One rod was used to transport the developer through the unit, the other one to mix toner with developer. The magnetic brushes had each a length PWE of 32 cm. They were staggered around the CTC and so that the magnetic brushes brought charged toner particles to the CTC over a length of 90 cm, which was equal to the length, $L_A$ of the rows of printing apertures.

The magnetic brushes were constituted of the so called magnetic roller, which in this case contained inside the roller assembly a stationary magnetic core, having three magnetic poles with an open position (no magnetic poles present) to enable used developer to fall off from the magnetic roller (open position was one quarter of the perimeter and located at the position opposite to said CTC. The magnetic brushes were so constructed that during operation fresh developer was pumped into its developer container at such a large flux that a large amount of developer was also falling out of the magnetic brush again. Said amount of "exhausted" developer falling out of said magnetic brush assembly was pumped over the scraper blade means in said charged toner conveyer to said container for developer in which 20 kg of developer was present. The sleeve of the magnetic brushes had a diameter of 20 mm and was made of stainless steel roughened with a fine grain to assist in transport (Ra=3 $\mu$m) and showed an external magnetic field strength in the zone between said magnetic brush and said CTC of 0.045 T, measured at the outer surface of the sleeve of the magnetic brush. The magnetic brush was connected to a DC power supply with a −50 V DC-offset.

A scraper blade was used to force developer to leave the magnetic roller. On the other side a doctoring blade was used to meter a small amount of developer onto the surface of said magnetic brush. The sleeve was rotating at a linear surface speed (LSM) four times higher than the linear surface speed (LSC) of said CTC roller, and in a direction opposite to the rotation direction of said CTC-roller. The reference surface of said CTC was placed at a distance between 650 $\mu$m from the reference surface of said magnetic brush.

The Printing Engine

The printhead structure, mounted in a PVC-frame, was bent with frictional contact over the surface of the roller of the charged toner conveyer roller. A 50 $\mu$m (this is distance d) thick polyurethane coating was used as self-regulating spacer means. The printhead structure in combination with the charged toner conveyer, the magnetic brushes, the scraper-blade with toner recovery, the developer supply to said magnetic brushes and the developer "recuperation" in said magnetic brush, was combined in a single frame, called "printing unit".

A single back electrode was present behind the paper whereon the to printing proceeded, the distance between the back electrode (105) and the back side of the printhead structure ($d_B$) was set to 1000 $\mu$m and the paper traveled a linear speed (LSM) of 200 cm/min. The back electrode was connected to a high voltage power supply, applying a voltage V4 of +1000 V to the back electrode.

The shield electrodes 106*b* were grounded: V2=0 V. To the individual control electrodes an (image-wise) voltage V3 between 0 V and +280 V was applied.

Measurement of Printing Quality

A printout made on paper with a DEP device and developer described above, was judged for homogeneity of the image density and possible banding after a long printing run.

Image banding could not be observed with this printing device. As a comparative example a printout was made with the same configuration but now the toner concentration was regulated for each magnetic brush assembly separately. After many meters of printing the "structure" of the 3 printing units, building the total printout, became clearly visible in the printing result.

It must be clear for those skilled in the art that many other implementations of cleaning, recovery and mixing systems than those shown in the figures and examples, can be provided without departing from the spirit of the present invention.

What is claimed is:

1. A large format single pass printer, having a printing width, PW, for printing a toner image on a substrate, the substrate having a width, WS, and a length, LS, comprising:

a charged toner conveyer, CTC, with a length, $L_{CTC}$, equal to or larger than a length $L_A$ and parallel to said printing width, PW, carrying charged toner particles on its surface and coupled to a voltage source so that a flow of charged toner particles is created from said surface towards said substrate, a printhead structure with an array of printing apertures, said array having said length, $L_A$, parallel to said printing width and being equal to or larger than said printing width, PW, and control electrodes associated with said printing apertures, said printhead structure being positioned between said CTC and said substrate and said control electrodes being coupled to a second voltage source arranged for image-wise modulating said flow of charged toner particles, and a number n, equal to or larger than 2, of toner applicators, separate from said printhead, for applying charged toner particles to said CTC, each of said applicators including a container for developer, said container having an active portion and a width $PWE_i$, in a direction of a longitudinal axis parallel to said length, $L_{CTC}$, smaller than said length $L_{CTC}$, said number n being chosen such that $$\sum_{i=1}^{i=n} PWE_i \geq L_A, \text{ and}$$

and a single central conditioning unit for controlling and monitoring said developer, said central conditioning unit being equipped with means for circulating said developer to all of said n toner applicators and back to said central unit;

wherein said means for circulating said developer from said central conditioning unit to all of said n toner applicators and back to said central unit are equipped as to have at any moment during printing at most 25% by volume of the developer present in the active portion of the containers of the toner applicators while at least 75% are continuously circulated through said central conditioning unit.

2. A large format printer according to claim 1, wherein said charged toner conveyor, CTC, is equipped with means for collecting non-used toner particles and said central condition unit is equipped to receive said non-used toner particles and with means for mixing said non-used toner particles with said developer.

3. A large format printer according to claim 2, wherein at least two of said longitudinal axis are parallel but not in line.

4. A large format printer according to claim 1, wherein at least two of said longitudinal axis are parallel but not in line.

5. A large format printer according to claim 4, wherein said toner applicators bring charged toner particles to said charged toner conveyor from a non-magnetic mono-component developer.

6. A large format printer according to claim 1, wherein said toner applicators bring charged toner particles to said charged toner conveyor from a two-component developer containing magnetic carrier particles and non-magnetic toner particles.

7. A large format printer to claim 1, wherein said toner applicators contain a magnetic brush with a diameter equal to or smaller than 30 mm.

8. A large format printer to claim 1, wherein said toner applicators have a container and a magnetic brush assembly therein, and the area of the cross-section of the magnetic brush (1041), $AREA_{MB}$ and the area of the container for developer, $AREA_{CONT}$ (1011), both area measured in the cross-section perpendicular to the length of the magnetic brush, relate to each other as $AREA_{MB}/AREA_{CONT} \geqq 0.3$.

9. A large format printer according to claim 1, wherein said toner applicators bring charged toner particles to said charged toner conveyor from a non-magnetic mono-component developer.

10. A large format printer according to claim 1, wherein said toner applicators bring charged toner particles to said charged toner conveyor from a non-magnetic mono-component developer.

11. A large format printer according to claim 1, wherein said toner applicators bring charged toner particles to said charged toner conveyor from a non-magnetic mono-component developer.

12. A large format single pass printer, having a printing width, PW, for printing a toner image on a substrate, the substrate having a width, WS, and a length, LS, comprising:

a charged toner conveyer, CTC, with a length, $L_{CTC}$, equal to or larger than said length $L_A$ and parallel to said printing width, PW, carrying charged toner particles on its surface and coupled to a voltage source so that a flow of charged toner particles is created from said surface towards said substrate, a printhead structure with an array of printing apertures, said array having a length, $L_A$, parallel to said printing width and being equal to or larger than said printing width, PW, and control electrodes associated with said printing apertures, said printhead structure being positioned between said CTC and said substrate and said control electrodes being coupled to a second voltage source arranged for image-wise modulating said flow of charged toner particles, and a number n, equal to or larger than 2, of toner applicators, separate from said printhead, for applying charged toner particles to said CTC, each of said applicators including a container for developer, said container having an active portion and a width $PWE_i$, in a direction of a longitudinal axis parallel to said length, $L_{CTC}$, smaller than said length $L_{CTC}$, said number n being chosen such that $$\sum_{i=1}^{i=n} PWE_i \geq L_A, \text{ and}$$

and a single central conditioning unit for controlling and monitoring said developer, said central conditioning unit being equipped with means for circulating said developer to all of said n toner applicators and back to said central unit;

wherein said charged toner conveyor, CTC, is equipped with means for collecting non-used toner particles and said central condition unit is equipped to receive said non-used toner particles and with means for mixing said non-used toner particles with said developer, and wherein said means for circulating said developer from said central conditioning unit to all of said n toner applicators and back to said central unit are equipped as to have at any moment during printing at most 25% by volume of the developer present in the active portion of the containers of the toner applicators while at least 75% are continuously circulated through said central conditioning unit.

13. A large format single pass printer, having a printing width, PW, for printing a toner image on a substrate, the substrate having a width, WS, and a length, LS, comprising:

a charged toner conveyer, CTC, with a length, $L_{CTC}$, equal to or larger than said length $L_A$ and parallel to said printing width, PW, carrying charged toner particles on its surface and coupled to a voltage source so that a flow of charged toner particles is created from said surface towards said substrate, a printhead structure with an array of printing apertures, said array having a length, $L_A$, parallel to said printing width and being equal to or larger than said printing width, PW, and control electrodes associated with said printing apertures, said printhead structure being positioned between said CTC and said substrate and said control electrodes being coupled to a second voltage source arranged for image-wise modulating said flow of charged toner particles, and a number n, equal to or larger than 2, of toner applicators, separate from said printhead, for applying charged toner particles to said CTC, each of said applicators including a container for developer, said container having an active portion and a width $PWE_i$, in a direction of a longitudinal axis parallel to said length, $L_{CTC}$, smaller than said length $L_{CTC}$, said number n being chosen such that $$\sum_{i=1}^{i=n} PWE_i \geq L_A, \text{ and}$$

and a single central conditioning unit for controlling and monitoring said developer, said central conditioning unit being equipped with means for circulating said developer to all of said n toner applicators and back to said central unit;

wherein at least two of said longitudinal axis are parallel but not in line, and wherein said means for circulating said developer from said central conditioning unit to all of said n toner applicators and back to said central unit are equipped as to have at any moment during printing at most 25% by volume of the developer present in the active portion of the containers of the toner applicators while at least 75% are continuously circulated through said central conditioning unit.

14. A large format printer, with printing width (PW), for printing a toner image on a substrate, having a width (WS) and a length (LS), comprising:

means for moving said substrate a first direction, means for moving a shuttle having a swath width, SWS, in a second direction, different from said first direction, said shuttle carrying:

a charged toner conveyer, CTC, with a length, $L_{CTC}$, equal to or larger than said length $L_A$ and parallel to said printing width, carrying charged toner particles on its surface and coupled to a voltage source so that a flow of charged toner particles is created from said surface towards said substrate, a printhead structure with an array of printing apertures, said array having a length, $L_A$, parallel to said printing width and equal to or larger than said printing width, PW, and control electrodes associated with said printing apertures, said printhead structure being positioned between said CTC and said substrate and said control electrodes being coupled to a second voltage source arranged for image-wise modulating said flow of charged toner particles, and a number n, equal to or larger than 2, of toner applicators for applying charged toner particles to said CTC, each of said applicators including a container for developer, said container having an active portion and a width $PWE_i$, in a direction of a longitudinal axis parallel to said length, $L_{CTC}$, smaller than said length $L_{CTC}$, said number n being chosen such that $$\sum_{i=1}^{i=n} PWE_i \geq L_A$$

and said printer further comprising a single central conditioning unit for controlling and monitoring a developer with toner particles and further equipped with means for circulating said developer to all of said n toner applicators and back to said central unit and said means for circulating said developer from said central conditioning unit to all of said n toner applicators and back to said central unit being equipped as to have at any moment during printing at most 25% by volume of the developer present in the active portion of the containers of the toner applicators while at least 75% are continuously circulated through said central conditioning unit.

15. A large format printer according to claim 14, wherein at least two of said longitudinal axis are parallel and not in line.

* * * * *